US005238140A

United States Patent [19]

Maze

[11] Patent Number: 5,238,140

[45] Date of Patent: Aug. 24, 1993

[54] MEDICATION STORAGE AND DISPENSING DEVICE

[76] Inventor: David L. Maze, 121 Greenland La., St. Louis, Mo. 63125

[21] Appl. No.: 900,320

[22] Filed: Jun. 18, 1992

[51] Int. Cl.[5] ..... B65D 5/56

[52] U.S. Cl. ..... 220/506; 220/527; 220/23.83; 206/217

[58] Field of Search ..... 220/506, 527, 528, 23.83, 220/23.86, 209; 206/38, 217, 547

[56] References Cited

U.S. PATENT DOCUMENTS

| | | | |
|---|---|---|---|
| 753,516 | 3/1904 | Pratt | 220/506 X |
| 975,939 | 11/1910 | Edwards | 206/547 |
| 1,471,793 | 10/1923 | Israel . | |
| 1,600,758 | 9/1926 | Goldstein . | |
| 2,469,856 | 5/1949 | Robertson | 220/527 X |
| 2,661,870 | 12/1953 | Huenergardt | 220/506 X |
| 2,750,066 | 6/1956 | Shekter | 220/23 |
| 2,766,796 | 10/1956 | Tupper | 206/217 X |
| 3,511,407 | 5/1970 | Palma | 220/209 |
| 4,307,820 | 12/1981 | Binoche | 220/367 X |
| 4,388,997 | 6/1983 | Grime | 220/209 |
| 4,548,339 | 10/1985 | Gorman | 220/506 X |
| 4,703,849 | 11/1987 | Vezirian et al. | 206/217 |
| 5,050,757 | 9/1991 | Hidding et al. | 220/23.83 |

OTHER PUBLICATIONS

The Company of Women Catalog Fall/Winter 1991-1992.

*Primary Examiner*—Steven M. Pollard
*Attorney, Agent, or Firm*—Kalish & Gilster

[57] ABSTRACT

A device for storing and dispensing both medication and liquid to take with such medication includes a flask which is such size as to permit storage of a sufficient amount of liquid to facilitate taking of at least one oral dose of medication. The flask is adapted for selective passage therethrough of a fluid substance and shaped for convenient comfortable long term carriage on the user's person. A medication container is fixed within the flask in such manner as to open outwardly therethrough and is provided with a selectively openable resealable lid. An adaptation for liquid dispensing is formed in the flask by which to provide access to liquid stored therein by the user when taking a dosage of medication which has been stored within the medication container. The liquid dispensing adaptation has a selectively openable resealable lid to prevent inadvertent spillage of liquid stored within the flask. A vent is formed in the flask in such manner as to prevent accidental spillage of liquid therefrom while also permitting entrance of air into the flask when negative internal pressure is applied during removal of liquid therefrom.

16 Claims, 2 Drawing Sheets

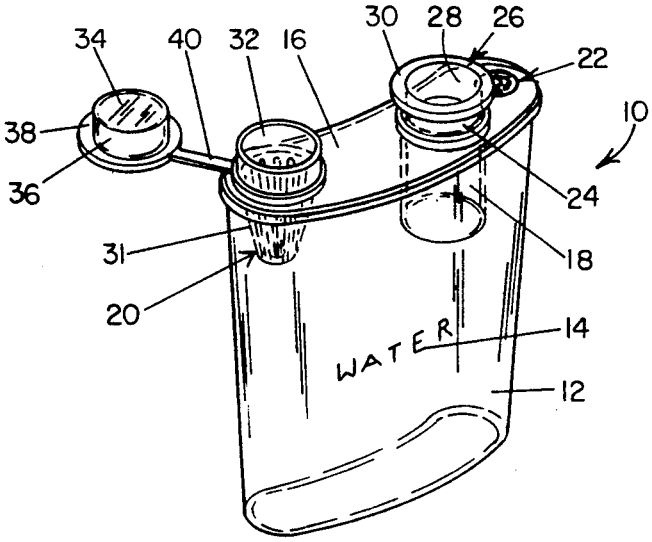
Fig. 1
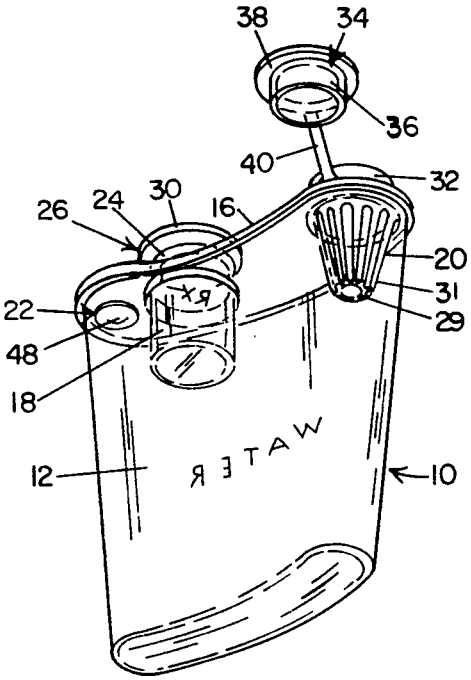
Fig. 2
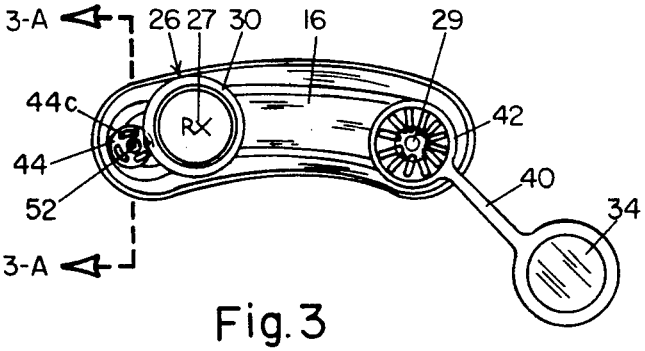
Fig. 3
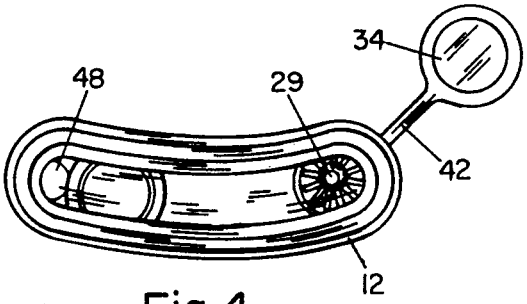
Fig. 4
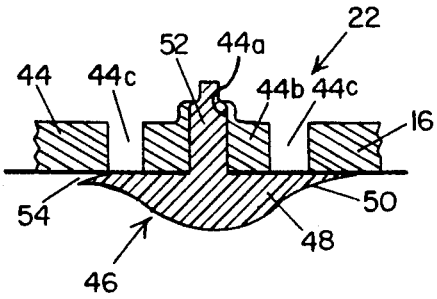
Fig. 3-A

MEDICATION STORAGE AND DISPENSING DEVICE

FIELD OF THE INVENTION

The present invention relates, generally, to the field of medication storage containers, and, more specifically, to a medication storage and dispensing device taking the form of a flask having separate, internal compartments for storage and dispensing of the user's medication, as well as a larger compartment for storage of liquid with which to take the medication.

BACKGROUND OF THE INVENTION

Numerous individuals are required to take medication between meals and throughout the course of the day, and if away from home or office must of necessity carry the medication on their persons for periods of at least several hours. At the same time, many drugs, whether prescription or otherwise, are more easily orally consumed if taken with water or some other liquid. Nevertheless, work place restrictions or, for example, recreational habits may limit or eliminate an individual's access to a faucet, water fountain, or other source of liquid. Thus there is a need for a device which permits an individual to conveniently carry one or more doses of medication on his or her person, along with a liquid for consuming with the appropriate dose.

DESCRIPTION OF THE PRIOR ART

Several small compartmentalized containers are known. For example, U.S. Pat. No. 2,766,796, which issued to Tupper, discloses a round plastic drinking vessel fitted with a tight-fitting lid having a separate compartment formed therein and provided with a second, separable, vacuum-type sealable lid for storage of medication therein. The lidded medication storage section of the Tupper device is completely separable from the drinking glass, and in fact must be removed from the glass for it to be usable, and thus may be accidentally mislaid, particularly by individuals having memory or vision difficulties. Moreover, the large drinking glass shape of the opaque Tupper container is not conducive to carrying on one's person for long periods of time, and may not fit in a standard-sized pocket at all.

Various styles of pocket-type flasks are disclosed in U.S. Pat. Nos. 1,471,793, 1,600,758, and 2,750,066; which issued to Israel, Goldstein and Shekter, respectively. The patent to Israel teaches a metal pocket flask for use by a miner to carry powdered calcium carbide lamp fuel which is poured from an opening provided with a small, hinged lid. The flask has a small internal compartment for storage therein of matches and is covered by a separate, hinged lid.

The patent which issued to Goldstein teaches a similar metal pocket flask for storage of carbide or tobacco and which has an internal compartment for storage of small items. The small compartment is fitted coextensively across the top of the flask and has a sliding double door-like lid which permits access at one end to the small compartment and access at the other end to the main body of the flask. Neither of the above pocket flasks are intended nor designed for liquid containment.

By contrast, the patent which issued to Shekter discloses a metal pocket flask for containment of liquids, which flask has an additional compartment therein for carrying either dry or liquid medicine. An outer lid fits over the entire top of the flask and ensures retention thereon of a smaller inner lid which fits over the opening to the liquid container portion and the liquid medication compartment in one embodiment. In an embodiment intended to store dry medication small compartments therefor are formed as part of the outer lid per se.

More recently, a much more complex device has been marketed under the name, Aqua Pill Timer, and includes an opaque plastic flask for containing liquid and having a coverable straw at one end, and a pill drawer at the other end. The device also has a battery operated, programmable, audible alarm and digital time read-out.

None of the known devices comprehends a convenient, carry-along see-through container for combined storage and dispensing of liquid or dry medication, which medication container is an integral subcompartment of a see-through liquid container which is adapted with a vent to prevent formation of a vacuum upon drinking of liquid therefrom. The prior art is also lacking an adaptation to medication dispensing devices which facilitates swallowing of dry medication by permitting simultaneous swallowing of liquid stored in the device.

SUMMARY OF THE INVENTION

Accordingly, it is among the several objects of the present invention to provide an inexpensive, easily used, combined medication storage and dispensing device which is light-weight and shaped so as to be easily carried on one's person for extended periods of time and which includes a tight resealable liquid container portion having at least one small compartment therein for separate storage of dry or liquid medication.

It is further among the objects of the present invention to provide a device having the features indicated which is substantially transparent or translucent so as to permit viewing of the amount of medication and liquid therein and which is adapted for facilitating taking of dry medication therefrom by allowing simultaneous swallowing of such dry medication and liquid from the device.

Thus, in furtherance of the above objects, the present invention is, briefly, a device for storing and dispensing both medication and liquid to take with or shortly after the medication. The device includes a flask which is of such size as to permit storage of a sufficient amount of liquid to facilitate taking of at least one oral dosage of medication and is adapted for selective passage therethrough of a fluid substance and is shaped for convenient, comfortable long term carriage on the user's person. There is a medication container fixed within the flask in such manner as to open outwardly therethrough and which is provided with a selectively openable resealable lid. A liquid dispenser is formed in the flask by which to effect access to liquid stored within the flask by the user when taking a dosage of medication which has been stored within the medication container. The liquid dispenser is adapted for selective receipt and temporary retention of dry medication and has a selectively openable resealable lid to prevent inadvertent spillage of liquid stored within the flask.

The invention further includes, briefly, a vent formed in the flask in such manner as to prevent accidental spillage of liquid therefrom while permitting entrance of air into the flask when negative internal pressure is applied thereto to facilitate removal of liquid therefrom. The vent has through-holes formed in a top of the flask and a valve connected to the top of the flask. The valve has a body portion normally in contact with an inner surface of the top of the flask in such manner as to cause fluid-tight sealing of the through-holes. The body portion of the valve is sufficiently releasable from contact with the inner surface of the top of the flask when subjected to negative pressure caused within the flask during drinking therefrom to permit air to flow into the flask via the through-holes to equalize pressure therein and thereby facilitate such drinking.

The liquid dispenser is further, briefly, a basket for temporary receipt of dry medication. The basket has an annular side wall which slants downwardly and inwardly to a centrally penetrated bottom. The side wall is provided with openings which permit passage therethrough of liquid from the flask to facilitate oral medicating thereby.

Other objects will be in part apparent and in part pointed out hereinbelow.

BRIEF DESCRIPTION OF THE DRAWINGS

FIG. 1 is a top front perspective view of a medication storage and dispensing device constructed in accordance with and embodying the present invention.

FIG. 2 is a bottom rear perspective view of the device shown in FIG. 1.

FIG. 3 is a top plan view thereof.

FIG. 3A is an enlarged, partial vertical sectional view taken on line 3A—3A of FIG. 3.

FIG. 4 is a bottom plan view of the device of FIG. 1.

Corresponding reference characters indicate corresponding parts throughout the several views of the drawing.

DESCRIPTION OF PREFERRED EMBODIMENTS OF THE INVENTION

Figure 5:
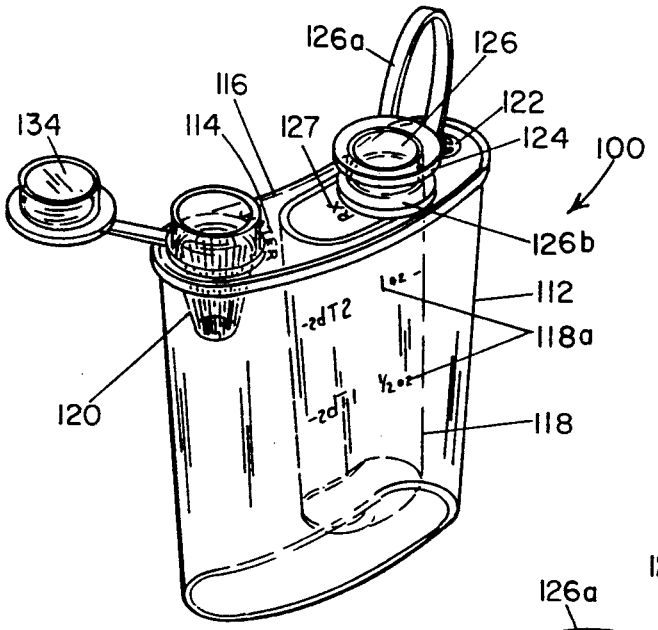
FIG. 5 is top front perspective view of a second embodiment the invention.

With reference to the drawings, 10 generally designates a first embodiment of a medication storage and dispensing device constructed in accordance with and embodying the present invention. Device 10 is preferably formed substantially entirely of transparent or translucent injection molded plastic, such as, for example, polystyrene, and includes a smooth-sided flask portion 12 having the usual flat-bottomed, continuous, curved-sided, pocket-flask shape for containment of approximately five ounces of water or other liquid therein and is usually provided with a label, such as that shown at 14 in FIGS. 1 and 2, to indicate the function thereof to the user. Flask 12 has a closed top 16 penetrated by a medication storage container 18, a slotted (or otherwise open-weave) basket 20 and an air vent 22 spacedly along the width thereof.

Medication storage container 18 is effectively suspended within flask 12 and is preferably generally cylindrical and closed bottomed and sized sufficiently large to contain several doses of pills or capsules, the exact number of course depending upon the sizes thereof. Optionally, device 10 may be provided as a smaller, sealed tamper-proof package, with container 18 prefilled with a single dose, and supplied with a smaller flask 12 for use by children who are only permitted to carry a single dose of medication under school rules.

The smooth, annular wall of container 18 forms a liquid impermeable seal with and extends outwardly of top 16 to form a neck portion 24 into which is fit a preferably completely separable circular lid or cap 26. Lid 26 has a depending annular wall 28 sized for resealable inside engagement with neck portion 24. Extending outwardly from annular wall 28 is an integral annular flange 30 which in normal use rests upon the outer edge of neck portion 24 to provide a gripping area and to prevent lid 26 from slipping into neck portion 24. Lid 26 may optionally be provided with a label, such as "Rx", as, for example, at 27 in FIG. 3, to make clear to the user the function of container 18. Alternatively, such "Rx" label may be imprinted at an appropriate position directly on top 16 of flask 12 to prevent potential confusion should lid 26 become misplaced.

Basket 20 has a preferably annular, slotted tapered wall 31 internally of flask 12 which slants downwardly and inwardly to terminate at an annular bottom which is desirably penetrated by an aperture 29. Basket 20 is sized sufficiently large to hold at least one tablet or capsule until device 10 is tilted, at which time tapered wall 31 encourages such medication to roll or slide out of basket 20 via a neck portion 32 which is defined by an annular wall which is sealed to and extends perpendicularly from flask top 16 at the intersection thereof with tapered wall 31. Such tilting action, when performed with liquid inside of flask 12 will allow such liquid (usually water) to pass through slotted tapered wall 31. Thus with the user's mouth at neck portion 32 of basket 20 both medication and liquid can pass simultaneously into the user's mouth, greatly facilitating swallowing of the medication.

At all times when device 10 is not in use for dispensing medication basket 20 is kept sufficiently tightly closed so as to prevent liquid from leaking from flask 12. Such closure is effected by a resealable circular lid 34 which has an annular wall 36 and annular flange 38 extending perpendicularly therefrom. Wall 36 is sized to slidably and snugly engage internally of neck portion 32 of basket 20. In similar fashion as described with reference to lid 26, flange 38 of lid 34 seats upon neck portion 32 to permit grasping for removal of lid 34 and prevents same from slipping completely into neck portion 32.

Lid 34 as shown has the additional feature of a tab 40 which connects at opposed ends thereof to flange 38 and a collar 42 which tightly surrounds neck portion 32 to prevent inadvertent misplacement of lid 34 when medication is being dispensed via basket 16. A similar tab is preferably not provided on lid 26 because it is expected that for convenience (because the diameter of neck 24 is too small to insert one's fingers thereinto), that a pill, capsule or powdered medication may be transferred by a "pouring" action into the area of lid 26 defined by annular wall 28 and then flipped or poured into basket 20 for dispensing as previously described. Lack of a connecting tab permits this free movement of lid 26.

When used as just described, lid 26 is unlikely to be lost as it will still be in the user's hand after transfer of the desired dosage of medication and then immediately replaced on neck portion 24 of container 18 so as to prevent spillage therefrom of any additional medication still stored therein at the time of dosage.

Most preferably, however, lid 34 is also be provided without integral tab 40, so as to be unattached so that medication may be freely transferred from lid 26 to lid 34 for subsequent transfer to slotted basket 20. This lid-to-lid transfer technique may be particularly useful for individuals with a diminished sense of touch; especially when the pills to be taken are extremely small, such as several millimeters in diameter. If powdered medication is to be consumed it may be similarly transferred, filtered through basket 20 and dissolved in whatever liquid is stored in flask 12 for easier consumption of the medication.

Ease of drinking from flask 12 is enhanced by provision of vent 22. The preferred form of air vent 22 is illustrated most clearly in FIG. 3A where it is shown in enlarged vertical section. Vent 22 is formed on flask top 16 in order to allow entrance of air into flask 12 when a user drinks therefrom via neck 32 of basket 20, so as to permit easier drinking than would otherwise be possible. As would be expected in this case, as in any situation involving drawing liquid through a small opening of an otherwise closed container, at least a partial vacuum will form within the container, here flask 12. Thus, in order to ease drinking of liquid from flask 12, it is necessary to allow access of air thereto. In the present instance, it is necessary that air vent 22 be structured so as to accomplish the above object yet also not permit liquid leakage from flask 12 to occur at any time when a dosage is not being taken in the manner to be described.

In order to accomplish the above, air vent 22 includes a valve, preferably of the commercially available type sometimes referred to as an "umbrella" valve such as that illustrated at 46 and is formed of two interengaged reasonably flexible plastic parts, specifically circular body or umbrella portion 48 and shaft portion 52. Vent 22 also includes a generally disk-shaped area 44 of flask top 16 for interconnection with valve 46. Area 44 of top 16 includes a central aperture **44*a* which is defined by smaller circular central portion 44*b*. Outward of central portion 44*b* disk-shaped area 44 is penetrated desirably by a plurality of oblong or kidney-shaped through-holes 44*c***.

Located inside of flask 12, flush against the inner surface of top 16 directly beneath disk portion 44 is circular round body portion 48 which is centrally thickened and tapers outwardly to a thin annular edge 50. Extending centrally upwardly from circular body portion 48 is shaft 52 which penetrates top 16 via aperture **44*a* in secure, tight-fitting relationship. So positioned, circular body portion 48 effectively blocks through-holes 44*c* to prevent passage of fluid to or from flask 12 under normal conditions; until, automatica under negative pressure caused by withdrawal of such liquid, thin edge 50 of circular body portion 48 pulls slightly away from the inside of top 16, as schematically illustrated by gap 54 in FIG. 3A, and thereby allows air to pass through one or more through-holes 44*c* into pocket flask 12 to equalize the pressure therein and permit liquid within flask 12** to flow more freely and so facilitate drinking.

FIGS. 5 through 8 illustrate a second embodiment 100 of the present invention, being structured more desirably for use in storing and dispensing a quantity, for example one ounce, of liquid medication. Device 100 is similar in many respects to device 10. Specifically, flask 112, basket 120 and air vent 122 are preferably substantially identical to flask 12, basket 20 and air vent 22, respectively, and thus, to avoid undue repetition, will not be further described, except to note that labels 114, 127 are optionally repositioned as compared with their counterparts 14, 27 in device 10 to indicate the openings for water and medication storage, respectively, so as to decrease any chance of user confusion. Also, because liquid medication will not be transferred, as previously described in the discussion of the first embodiment, basket 120 may be smaller or non-existent and the openings for access to flask 112 and medication container 118 may be provided with non-indented, or flat, caps or lids 126, 134, as long as selectively releasable, resealable engagement with the corresponding opening is accomplished.

Figure 6:
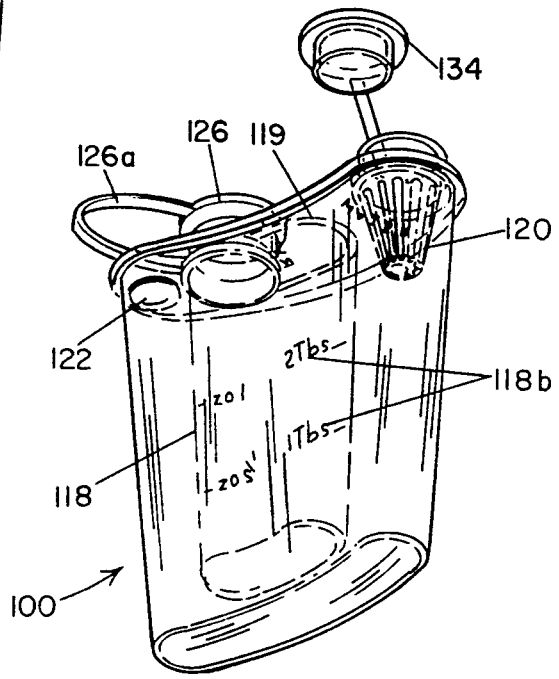
FIG. 6 is a bottom rear perspective view of the device of FIG. 5.
Figure 7:
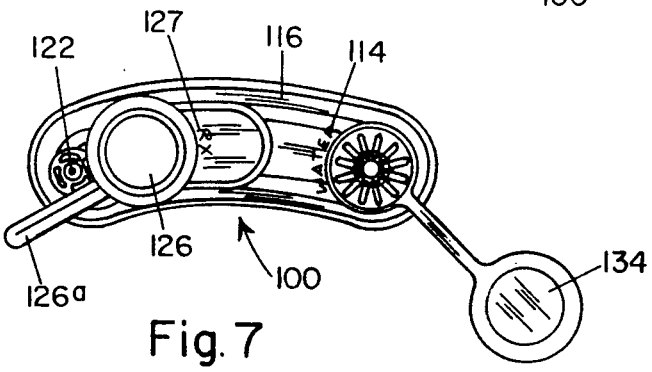
FIG. 7 is a top plan view thereof.
Figure 8:
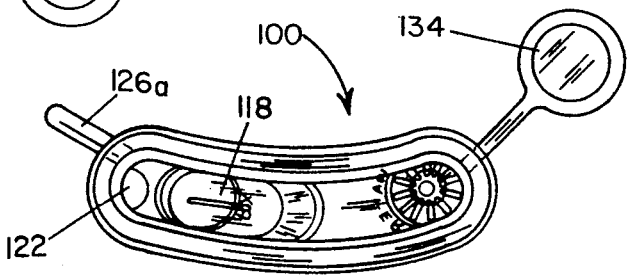
FIG. 8 is a bottom plan view thereof.

Medication container 118 is preferably attached so as to be suspended within device 100 and, as shown in FIGS. 5 and 6, consists of an elongated, hollow, close-bottomed body which is sealably fixed at its upper end 119 to the inside of flask top 116 where it communicates to the outside of flask 112 via annular neck portion 124. Neck portion 124 is openably sealed by resealable lid 126 which is similar to the previously described lid 26 except that it is connected by tab **126*a* and collar 126*b* to neck portion 124 to prevent inadvertent loss thereof. In this embodiment the dosage transfer function previously described with regard to lid 26 is not required and thus it is preferred to provide lid 126** in the described attached form, although it is understood that such minor alterations in either embodiment will not substantially impair the functioning thereof.

Liquid medication container 118 is also preferably provided with volume markings, such as those indicated at **118*a*, 118*b* in FIGS. 5 and 6, to accurately indicated the volume of liquid medication stored therein and thus to avoid misdosage and its attendant considerations. It will be noted that markings 118*a*, 118*b* as shown are for ounces and tablespoons, respectively, but it will be appreciated that cubic centimeter or millimeter markings may be substituted as necessary, as long as such markings can be seen through the side walls of flask portion 112. It is desired that both embodiments of the device 10, 100 be constructed of materials which are at least translucent and capable of being injection molded. However, it is understood that same will function acceptably even if formed of other materials, such as metal, or partially of metal. There will be some disadvantage in that case, however in that visibility of the contents of device 10, 100** will be decreased and the device may be more expensive to produce.

It is understood that certain modifications may be made to each embodiment of the new medication storage and dispensing container without significantly altering the function thereof. For example, certain other materials, some of which may yet to be invented, as well as other closure types and shapes and connection of various portions may conceivably be used satisfactorily. If desired, lids 26, 34 may be provided in colors, textures, or shapes which differ from each other to facilitate distinguishing same from one another. This option may be of critical importance to the visually impaired in order to prevent improper medicating. Similarly, other vent means and shapes for basket 20 and containers 18, 118 may conceivably be adequately substituted for those described. Although it is preferred that the flask, top and basket and medication be hermetically sealed at any intersections thereof, as by ultrasonic welding, it is presumed other methods of attachment will suffice.

In view of the foregoing, it will be seen that the several objects of the invention are achieved and other advantages are attained.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. A device for storing and dispensing both medication and liquid to take with the medication, said device comprising;

a flask which is of such size as to permit storage of a sufficient amount of liquid to facilitate taking of at least one oral dosage of medication, the flask being adapted for selective passage therethrough of a fluid substance and shaped for convenient, comfortable long term carriage on the user's person;

a medication container fixed within said flask in such manner as to open outwardly therethrough and provided with a selectively openable resealable lid;

liquid dispensing means formed in said flask to effect access to liquid stored within said flask by the user when taking a dosage of medication which has been stored within the medication container, said liquid dispensing means having a selectively openable resealable lid to prevent inadvertent spillage of liquid stored within said flask, and comprising a basket, said basket having a side wall which slants downwardly and inwardly to a centrally penetrated bottom, the side wall being provided with openings which permit passage therethrough of liquid from said flask to facilitate oral medicating thereby.

2. The device of claim 1, and further comprising vent means formed in said flask in such manner as to prevent accidental spillage of liquid therefrom while also permitting entrance of air into said flask when negative internal pressure is applied thereto, to facilitate removal of liquid therefrom.

3. The device of claim 2, wherein said vent means comprises through-holes formed in a top of said flask and a valve connected to the top of said flask, said valve having a body portion normally in contact with an inner surface of the top of said flask in such manner as to cause fluid-tight sealing of the through-holes, the body portion of said valve being sufficiently releasable from contact with the top of said flask when subjected to negative pressure caused within said flask during drinking therefrom to permit air to flow into said flask via said through-holes to equalize pressure therein and thereby facilitate such drinking.

4. The device of claim 2, wherein said vent means is automatic, operating under negative pressure caused by withdrawal of the liquid from said flask.

5. The device of claim 4, wherein said vent means is an umbrella valve.

6. The device of claim 1, wherein said flask and said medication container fixed therein are each formed of material which is substantially transparent for permitting viewing of the contents thereof.

7. The device of claim 1, wherein said device is formed of material which may be injection molded.

8. The device of claim 1, wherein said medication container is of sufficient size to hold at least one dosage of liquid medication and is provided with volume markings thereon.

9. The device of claim 8, and further wherein said liquid dispensing means is adapted for receipt and temporary retention of the at least one dosage of dry medication.

10. The device of claim 1, wherein said medication container is adapted for storage of at least one dosage of dry medication.

11. The device of claim 1, wherein said flask is shaped as a pocket flask.

12. The device of claim 1, wherein said medication container, liquid dispensing means and vent means each open outwardly through a top of said flask.

13. The device of claim 1, wherein at least one of the selectively openable resealable lids of said medication container and said liquid dispensing means is formed with an integral tab for attachment to said flask.

14. The device of claim 1, wherein said basket wall is annular.

15. The device of claim 1, wherein said medication container is fixed to and opens outwardly through an inside surface of a top of said flask.

16. A device for storing and dispensing both medication and liquid to take with the medication, said device comprising;

a flask which is of such size as to permit storage of a sufficient amount of liquid to facilitate taking of at least one oral dosage of medication, said flask having a top surface adapted for selective passage therethrough of a fluid substance and said flask being shaped for convenient, comfortable long term carriage on the user's person;

a medication container fixed within said flask in such manner as to open outwardly through the top surface and provided with a selectively openable resealable lid;

liquid dispensing means formed in the top surface of said flask to effect access to liquid stored within said flask by the user when taking a dosage of medication which has been stored within the medication container, said liquid dispensing means having a selectively openable resealable lid to prevent inadvertent spillage of liquid stored within said flask;

automatic vent means formed int he top surface of said flask substantially adjacent to said medication container in such manner as to prevent accidental spillage of liquid from said flask while also permitting entrance of air into said flask when negative internal pressure is applied thereto, to facilitate removal of liquid therefrom and comprising a basket, said basket having a side wall which slants downwardly and inwardly to a centrally penetrated bottom, the side wall being provided with openings which permit passage therethrough of liquid from said flask to facilitate oral medicating thereby.

* * * * *